United States Patent [19]

Fujikawa et al.

[11] Patent Number: 4,509,445

[45] Date of Patent: Apr. 9, 1985

[54] SEWING MACHINE CONTROL DEVICE

[75] Inventors: Katsuhiro Fujikawa; Osamu Gohda, both of Aichi, Japan

[73] Assignee: Mitsubishi Denki K.K., Tokyo, Japan

[21] Appl. No.: 463,763

[22] Filed: Feb. 4, 1983

[30] Foreign Application Priority Data

Feb. 4, 1982 [JP] Japan ..... 57/16611

[51] Int. Cl.[3] ..... D05B 69/18; D05B 69/20

[52] U.S. Cl. ..... 112/317

[58] Field of Search ..... 112/317, 316, 121.11, 112/275, 277, 262.1

[56] References Cited

U.S. PATENT DOCUMENTS

| | | | |
|---|---|---|---|
| 4,154,179 | 5/1979 | Arnold | 112/317 |
| 4,182,252 | 1/1980 | Yoneji et al. | 112/317 |
| 4,195,582 | 4/1980 | Novick | 112/121.11 |

*Primary Examiner*—Peter Nerbun

*Attorney, Agent, or Firm*—Sughrue, Mion, Zinn, Macpeak & Seas

[57] ABSTRACT

A control device for a sewing machine, in which the numbers of stitches in forward and backward feed of an article to be sewed are preset, comprises: a reverse-stitching electromagnetic operating unit for reversing the direction of feed of the article; a control unit for applying instruction signals to the electromagnetic operation unit to control the latter; and delay means for controlling the operation delay time between the turning "on" or "off" of the electrical instruction signal which is applied to the electromagnetic operating unit by the control means and the turning "on" or "off" of the electromagnetic operating unit. The time instant that the instruction signal is turned "on" or "off" by the control means is caused to occur a period of time, corresponding to the operation delay time, earlier than a predetermined time instant, so that the number of stitches preset is equal to the number of stitches actually formed.

16 Claims, 6 Drawing Figures

SEWING MACHINE CONTROL DEVICE

BACKGROUND OF THE INVENTION

1. Field of the Invention

This invention relates to control devices for sewing machines, and more particularly to a control device for a sewing machine in which the number of stitches in forward and backward feeding of an article to be sewed can be preset.

2. Description of the Prior Art

A conventional control device of this type comprises a control section including a microcomputer; and an electromagnetic operating unit, including a reverse-stitching electromagnet, the electromagnet operating unit being controlled by the control section through a circuit comprising resistors, a transistor and a varistor. In a sewing machine having such a control device, first stitching in the forward direction is carried out while a detector on the rotary arm shaft of the sewing machine outputs a count signal corresponding to the number of revolutions of the sewing machine. The count signal thus outputted is counted by the control section and, when the count value reaches the number of stitches (A) which has been preset, the control section turns on the transistor to drive the reverse-stitching electromagnetic operating unit.

As a result, the reverse-stitching electromagnet is excited, and the direction of stitching is reversed. Similarly, as in the forward feed, the count signal from the detector is counted. When the count value reaches the number of stitches (B) which has been preset, the control section renders the transistor non-conductive (off) to release the electromagnetic operating unit and thereby again change the direction of stitching.

Even if the number of stitches (A) and (B) are preset to four and four, respectively ((A)=4, and (B)=4), the number of stitches actually formed are not always equal to those preset, because there is a delay time before the electromagnetic operating unit is operated after the transistor is rendered conductive (on) or non-conductive (off). The delay time always occurs, although it is not always constant.

For the above-described reason, the conventional sewing machine control device is disadvantageous in that the number of stitches preset is not always equal to the number of stitches actually formed, and accordingly, in order to obtain the desired number of stitches it is necessary to adjust the number of stitches preset through "trial and error" while monitoring the number of stitches actually formed.

SUMMARY OF THE INVENTION

In view of the foregoing, an object of this invention is to provide a control device for a sewing machine in which the number of stitches preset is positively equal to the number of stitches actually formed by merely adding simple means to the conventional control device.

In order to achieve the aforementioned object, in a sewing machine comprising a drive mechanism for driving the sewing machine, a reverse-stitching electromagnetic operating unit at least for reversing the direction of feed in the sewing machine, and a control device for controlling the number of stitches in forward and backward feed and controlling the drive mechanism and the electromagnetic operating unit, there is provided according to this invention a means for controlling the operation time delay which may occur after an electrical instruction signal from the electromagnetic operating unit is turned "on" or "off", and in order to form exactly the desired number of reversed stitches, the electrical instruction signal of the reverse-stitching electromagnetic operating unit is turned "on" or "off" before the number of stitches preset is actually counted up.

The nature, principle and utility of the invention will become more apparent from the following detailed description and the appended claims when read in conjunction with the accompanying drawings.

DETAILED DESCRIPTION OF THE PREFERRED EMBODIMENTS

Preferred embodiments of this invention will now be described with reference to the accompanying drawings.

Figure 1:
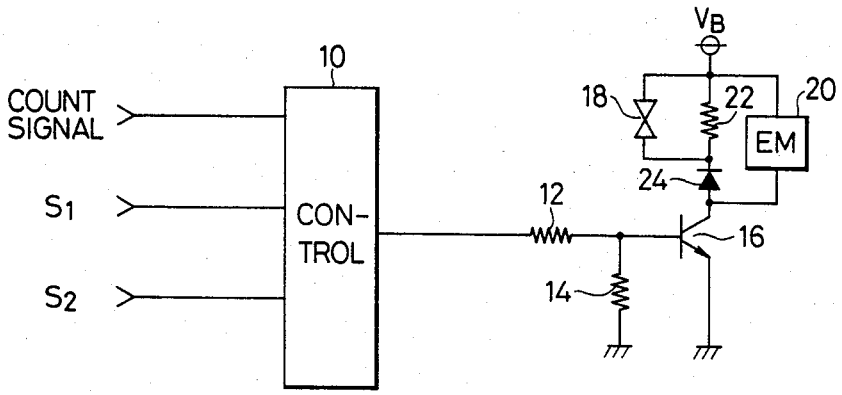
FIG. 1 is a circuit diagram, partly as a block diagram, showing one example of a sewing machine control device according to this invention.

FIG. 1 shows a first example of a sewing machine control device according to the invention. Similarly as in the above-described conventional control device, the control device of the invention has a control section 10 employing a microcomputer, resistors 12 and 14, a transistor 16, a varistor 18 and a reverse-stitching electromagnetic (EM) operating unit 20. The control device of the invention further comprises a resistor 22 and a diode 24. The rating of the resistor 22 and the diode 24 which are added according to the invention is determined in accordance with the characteristic of the electromagnetic operating unit including a reverse-stitching electromagnet. The resistor 22 and the diode 24 operate to set an operation time delay from each of the "on" and "off" operations of the transistor 16 of the electromagnetic operating unit 20 to the first stitch, with the delay being expressed in terms of stitches. In each of the "on" and "off" operations, the time delay is set to one stitch.

Figure 3:
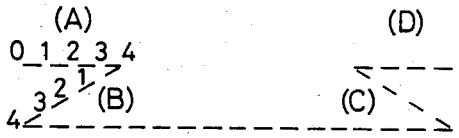
FIG. 3 is an explanatory diagram showing stitches which are actually formed by the control unit in FIG. 1.

It is assumed that stitching is carried out as shown in FIG. 3. For instance when the operator operates a switch to provide a signal $S_1$, the control section 10 counts a count signal which is supplied by a detector (not shown) mounted on a rotary arm shaft adapted to drive the needle in the sewing machine body. When the count value reaches ((A)−1) where (A) is the number of stitches which has been preset, the transistor 16 is turned on (rendered conductive), so that the electromagnetic operating unit 20 is driven. When the counter value reaches (A), driving of the electromagnetic operating unit 20 is completed, so that the direction of feed is reversed; that is, a backward movement is effected.

The control section again starts counting the number of stitches. When the count value reaches ((B)−1), the transistor 16 is turned off (rendered non-conductive), so that the electromagnetic operating unit 20 is released. When the count value reaches (B), the direction of feed is mechanically changed; that is, the original forward movement is effected again. In steps (C) and (D), the control is similar to that described above.

Figure 2:
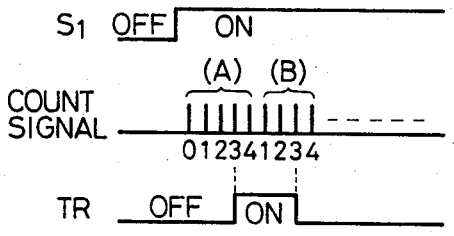
FIG. 2 is a time chart for a description of one example of the reverse-stitching operation of the control device in FIG. 1.

FIG. 2 is a time chart for steps (A) and (B) described above, with (A)=4 and (B)=4. In this case, the actual stitches are as shown in FIG. 3, and a flow chart for the control section 10 is as shown in FIG. 4.

Figure 4:
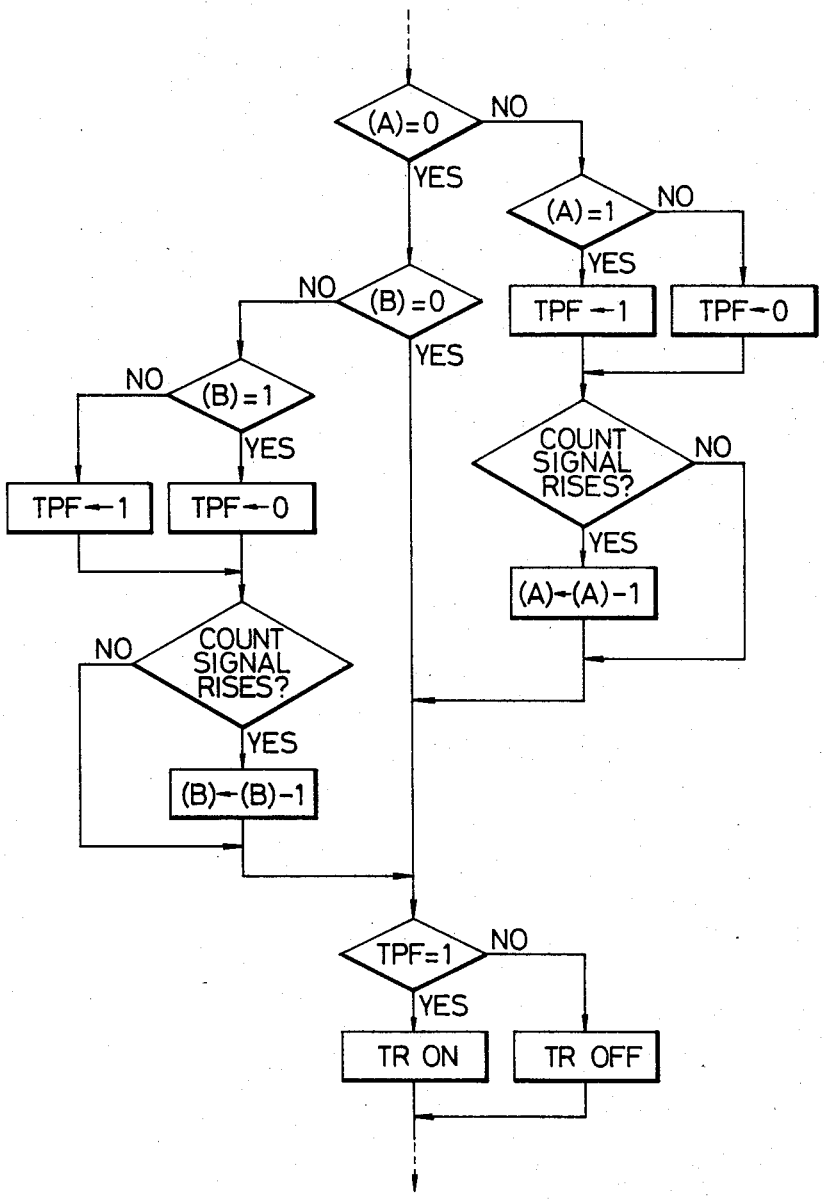
FIG. 4 is a flow chart for a description of the stitching in FIG. 3.

As shown in the flow chart of FIG. 4, when the number of stitches (A) is not zero (0), it is determined whether (A) is one (1) or not. After the count signal which is supplied from the detector on the rotary arm shaft in the sewing machine body to the control section 10 rises, subtraction is carried out according to the count signal. When the remaining number of stitches (A) to be formed is one (1), a transistor on/off program flag (hereinafter abbreviated as "TPF", when applicable) is set to "1". When the TPF is at "1", the transistor 16 is turned on; and when the TPF is at "0", the transistor 16 is turned off. Accordingly, when the TPF is set to "1", the transistor 16 is turned on, and the electromagnetic operating unit 20 is therefore driven at the time instant when ((A)−1) is counted.

After the step of stitching (A) stitches, the step of switching (B) stitches is effected and it is determined whether or not the number of stitches is zero (0). In the step of stitching (B) stitches, stitching is carried out in the backward direction, because the transistor 16 has been turned on during the step of stitching (A) stitches.

Similarly as in the step of stitching (A) stitches, counting is continued until the remaining number of stitches (B) being counted is one (1). Thereupon, the TPF is set to "0", and the transistor 16 is turned off, so that the electromagnetic operating unit 20 is restored so that the forward stitching can be carried out.

As is apparent from the above description, according to the invention, the number of stitches which are preset can be made exactly equal to that which is actually provided.

Figure 5:
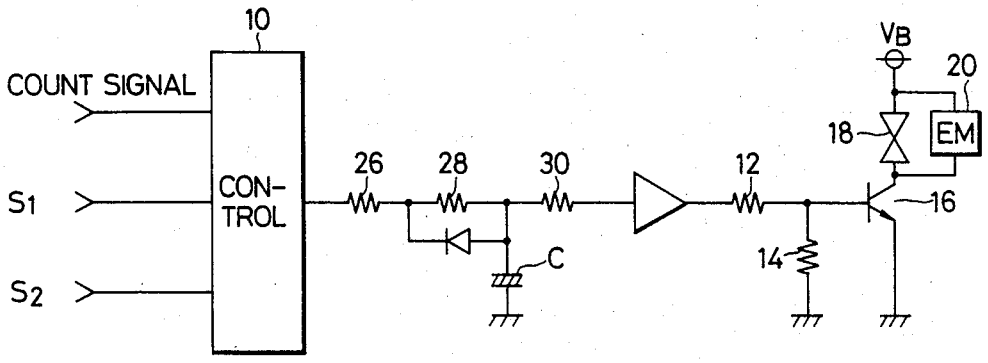
FIG. 5 is a circuit diagram, partly as a block diagram, showing another example of the control device according to the invention.
Figure 6:
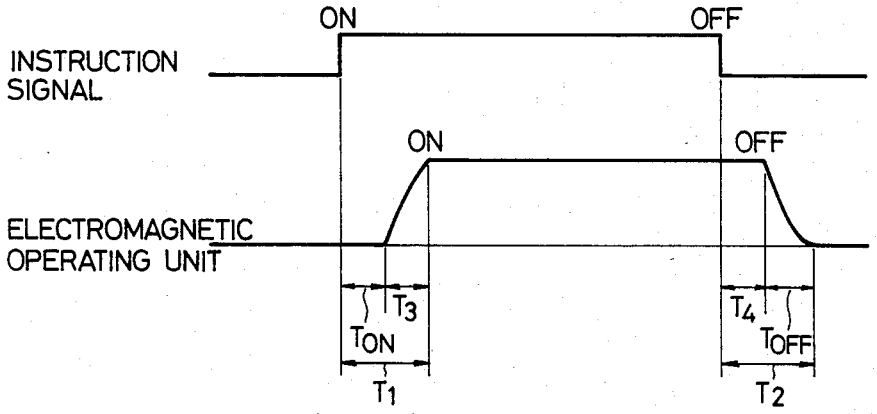
FIG. 6 is a time chart for a description of the reverse stitching operation of the control device in FIG. 5.

In the control device shown in FIGS. 1 through 4, in order to control the operation time delay from the turning "on" or "off" of the electrical instruction signal to the electromagnetic operating unit, the resistor and the diode are employed; however, the invention is not limited thereto or thereby. FIGS. 5 and 6 show a second example of the control device using a so-called "RC timer" with a resistor and a capacitor.

In FIGS. 5 and 6, reference character $T_1$ designates a delay between the turning "on" of the instruction signal of the control section 10 and the turning "on" of the electromagnetic operating (EM) unit 20, and $T_2$, a delay between the turning "off" of the instruction signal and the turning "off" of the operating unit 20. If the delay in turning on the electromagnetic operating unit 20 (mainly its solenoid) is represented by $T_{on}$, and the delay in turning off the same is represented by $T_{off}$, then as is apparent from FIG. 6, $$T_1 = T_{on} + T_3$$

$$T_2 = T_{off} + T_4$$

Accordingly, by determining $T_3$ with the set values of resistors 26 and 28 and a capacitor C in FIG. 5, $T_1$ can be made equal to a time corresponding to a time required for stitching one stitch. Similarly, by determining $T_4$ with the set values of the resistor 26 and the capacitor C in FIG. 5, $T_2$ can be made equal to a time corresponding to a time required for stitching one stitch. The remaining aspects of the operation of the embodiment of FIGS. 5 and 6 are similar to those of the first example shown in FIGS. 1 through 4.

Thus, in the second example in FIGS. 5 and 6 also, the control section 10 counts the number of stitches and when the count value reaches the set number of stitches minus one, the drive instruction signal of the electromagnetic operating unit 20 is turned on or off. Accordingly, the set number of stitches is positively equal to the actual number of stitches.

In the above-described examples of the control device, the reverse stitching electromagnetic operating unit 20 is electrically turned on or off when the set number of stitches minus one is counted; however, depending on the characteristic of an electromagnetic (EM) operating unit 20 used, the control device may be so modified that the transistor 16 is turned on or off when the set number of stitches minus a half (stitch) is counted by changing the values of the resistors 26 and 28 and capacitor C or by changing the processing program. Furthermore, it goes without saying that the control section 10 can be made up of individual parts.

In practice, a sewing machine needs a driving mechanism such as a motor to drive the sewing machine and a braking mechanism to stop the sewing machine. The above-described control section 10 controls the driving mechanism, the braking mechanism, and the electromagnetic operating unit.

We claim:

1. A control device for a sewing machine of the type including means for generating a stitch signal corresponding to each stitch sewed, means for indicating a desired stitch count representing the number of stiches to be sewed while feeding an article in a first direction, and reverse-stitching electromagnetic operating unit for controlling the direction of feed of said article in response to an electrical instruction signal, said electromagnetic operating unit turning "on" in response to a first state of said electrical instruction signal to feed said article in said first direction and turning "off" in response to a second state of said electrical instruction signal to feed said article in a second direction, said control device further including control means for controlling the on and off switching of said electromagnetic operating unit, said control means comprising:

delay means for controlling the duration of a delay time interval between the switching of said electrical instruction signal from said first state to said second state and the corresponding switching of said electromagnetic operating unit from "on" to "off";

counting means responsive to said stitch signal for generating an actual stitch count signal representing the number of stitches which have been sewed while feeding said article in said first direction; and means for determining when said actual stitch count reaches a first count value which is less than said desired stitch count value by a predetermined amount, said predetermined amount corresponding to said delay time interval, said control means switching said electrical instruction signal from said first state to said second state when said actual count value reaches said first count value.

2. A control device as claimed in claim 1, in which said electromagnetic operating unit includes a solenoid mechanism.

3. A control device as claimed in claim 1, in which said delay means includes a series circuit of a diode and a resistor.

4. A control device as claimed in claim 3, in which said series circuit is connected in parallel with said electromagnetic operating unit.

5. A control device as claimed in claim 1, in which said delay means includes a timer element comprising a resistor and a capacitor.

6. A control device as claimed in claim 5, wherein said timer element is coupled in series between said control means and said electromagnetic operating unit.

7. A control device as claimed in claim 1, wherein said control means counts the number of stitches formed and turns said electrical instruction signal "on" or "off" when the counted number of stitches is smaller by one stitch than said preset number of stitches.

8. A control device for a sewing machine of the type including means for generating a stitch signal corresponding to each stitch sewed, means for indicating a first desired stitch count representing the number of stitches to be sewed while feeding an article in a first direction, means for indicating a second desired stitch count representing the number of stitches to be sewed while feeding said article in a second direction, and a reverse-stitching electromagnetic operating unit for controlling the direction of feed of said article in response to an electrical instruction signal, said electromagnetic operating unit turning "on" in response to a first state of said electrical instruction signal to feed said article in said first direction and turning "off" in response to a second state of said electrical instruction signal to feed said article in said second direction, said control device further including control means for controlling the "on" and "off" switching of said electromagnetic operating unit, said control means comprising:

delay means for controlling the duration of a first operation time delay between the switching of said electrical instruction signals from said second state to said first state and the corresponding switching of said electromagnetic operating unit from "off" to "on", and for controlling the duration of a second operation time delay between the switching of said electrical instruction signals from said first state to said second state and the corresponding switching of said electromagnetic operating unit from "on" to "off";

counting means responsive to said stitch signal for generating an actual stitch count signal representing the number of stitches which have been sewed while feeding said article in either one of said first and second directions;

means for determining when said actual stitch count reaches a first count value which is smaller than said first desired stitch count by a first predetermined value during feeding of said article in said second direction and for determining when said actual stitch count reaches a second count value which is less than said second desired stitch count by a second predetermined value during feeding of said article in said first direction, said first and second predetermined values corresponding to said first and second operation time delays, respectively; and said control means switching said electrical instruction signal from said first state to said second state when said actual stitch count reaches said first count value and for switching said electrical instruction signal from said second state to said first state when said actual stitch count reaches said second count value.

9. A control device as claimed in claim 8, wherein said first and second predetermined values are the same.

10. A control device as claimed in claim 9, wherein said predetermined value is one.

11. A control device as claimed in claim 8, wherein at least one of said first and second predetermined values is a non-integer number.

12. A control device as claimed in claim 8, in which said electromagnetic operating unit comprises a solenoid mechanism.

13. A control device as claimed in claim 8, in which said delay means includes a series circuit of a diode and a resistor.

14. A control device as claimed in claim 13, wherein said series circuit is coupled in parallel with said electromagnetic operating unit.

15. A control device as claimed in claim 8, in which said delay means comprises a timer element which includes a resistor and a capacitor.

16. A control device as claimed in claim 15, wherein said timer element is coupled in series between said control means and said electromagnetic operating unit.

* * * * *